US010959597B2

(12) United States Patent
Saunders

(10) Patent No.: US 10,959,597 B2
(45) Date of Patent: Mar. 30, 2021

(54) APPARATUS AND METHOD FOR DISHWASHER STATUS INDICATION

(71) Applicant: Reginald Eugene Saunders, Perth Amboy, NJ (US)

(72) Inventor: Reginald Eugene Saunders, Perth Amboy, NJ (US)

( * ) Notice: Subject to any disclaimer, the term of this patent is extended or adjusted under 35 U.S.C. 154(b) by 196 days.

(21) Appl. No.: 15/876,144

(22) Filed: Jan. 20, 2018

(65) Prior Publication Data

US 2019/0223686 A1 Jul. 25, 2019

(51) Int. Cl.
*A47L 15/42* (2006.01)

(52) U.S. Cl.
CPC ..... *A47L 15/4295* (2013.01); *A47L 15/4257* (2013.01); *A47L 15/4287* (2013.01); *A47L 2401/04* (2013.01); *A47L 2401/26* (2013.01)

(58) Field of Classification Search
CPC ..... A47L 15/4257; A47L 15/4293; A47L 15/4295; G08B 21/18
See application file for complete search history.

(56) References Cited

U.S. PATENT DOCUMENTS

| | | | | |
|---|---|---|---|---|
| 5,151,884 | A * | 9/1992 | Griffith | A47L 15/0049 134/57 D |
| 5,229,753 | A * | 7/1993 | Berg | A47L 15/507 134/113 |
| 5,839,458 | A | 11/1998 | Delcarson | |
| 6,196,239 | B1 | 3/2001 | Eskey | |
| 6,295,004 | B1 * | 9/2001 | Burnett | A47L 15/4257 134/113 |
| 6,700,500 | B1 * | 3/2004 | Burnett | A47L 15/4257 134/113 |
| 7,516,746 | B1 | 4/2009 | Davis | |
| 9,119,522 | B1 | 9/2015 | Barksdale | |
| 2013/0228202 | A1 * | 9/2013 | Welch | A47L 15/4259 134/200 |
| 2016/0262594 | A1 * | 9/2016 | Chan | A47L 15/4293 |
| 2018/0088549 | A1 * | 3/2018 | Strahle | D06F 33/02 |

* cited by examiner

*Primary Examiner* — Ryan A Reis

(57) ABSTRACT

An apparatus and method is describe herein for a device which when attached to a front-loading dishwashing appliance with a vented drop-down door gives an indication to the user as to whether the dishes, glasses and utensils placed within are soiled or cleaned. The device includes a heat sensing means attached to a extending member, an inclination sensing means which is responsive to the deviation of the dishwashing appliance door and therefore the device from the vertical position and a system of timers.

19 Claims, 4 Drawing Sheets

APPARATUS AND METHOD FOR DISHWASHER STATUS INDICATION

FIELD OF INVENTION

The present invention relates generally to dishwashing apparatus and more specifically to a device which when attached to a front-loading dishwashing machine with a vented drop-down door gives an indication to the user as to whether the dishes placed within are soiled or cleaned.

BACKGROUND OF INVENTION

The dishwashing machine or dishwasher which it is more commonly referred to is an age old appliance present in countless households. It is also widely used commercially in restaurants and dining facilities worldwide. The dishwasher has been around in one form or another since the mid-1800. Just as age old is the problem of determining whether the dishes, glasses and other utensils that have been left in these mechanical appliances are clean or dirty.

The conventional domestic dishwasher is front-loading with a door which opens in a drop-down position. There is typically some form of venting slot on the front of the dishwasher door that connects with an opening on the inside surface of the door. The inside of the dishwasher consists of a large compartment with sliding rack shelving on which to place dishes, glasses and other utensils. Due to the length of a typical wash cycle (45 minutes to an hour), the dishwasher is often left unattended while it is running. The individual(s) subsequently removing items from or placing items in the dishwasher may not always be the one who originally started the dishwasher. Secondly, if the person that performs the prep of the soiled items does a very thorough job of scouring/rinsing them before placing them in the dishwasher, the dishes, glasses, etc. could appear to be clean when in fact they haven't been washed yet.

Various devices have been proposed in the past for indicating to an individual whether or not dishes in a dishwasher are clean or dirty. In U.S. Pat. No. 7,516,746 an indicating device is disclosed which consists of a main pyramidal shaped member with two prominent surfaces. Attached to main member is a rotating hook. On the first of the prominent surfaces is an indication that dishes are "clean". On the second prominent surfaces is an indication that dishes are "dirty". The other end of the hook of device attaches to the front of the upper dishwasher rack. When the device is vertically rotated forward such that main member is hung outside the rack, main member displays the indication "dirty" in addition to providing the novel feature of acting as a "stop" to hold the dishwasher door ajar. When the device is vertically rotated backward such that main member is hung inside rack, main member displays the indication "clean" and allows the dishwasher door to close completely. The shortcoming of this device is that it does contain an automatic means to transition it between the two states. If the user forgets to rotate the device to "dirty" after unloading or does not immediately run the dishwasher after rotating the device to "clean", the indicator will display "clean" when the dishes are, in fact, "dirty".

In U.S. Pat. No. 6,196,239 an indicating device is disclosed in which the problem of automatically detecting the "clean" state of the dishes in the dishwasher has been overcome. This is accomplished by a device which is also attached internally to the dish rack of dishwasher. The above device is comprised of a translucent housing having a front wall and containing an internal face plate which is visible and slidable within the translucent housing to one of two positions. A graphic image is formed on the inside surface of the housing front wall and on the front surface of the slidable face plate to provide a novel indication means. In the first position, the front wall and face plate form a composite image which indicates that the dishes are dirty. In the second position, the front wall and face plate form a composite image which indicates that the dishes are clean. The face place is held in the dirty indication position against the releasable force of a spring. Upon sensing (through dimensional changes in a tabbed flange) an elevated temperature indicating that the dishwasher has been run, the releasable holding mechanism (set by device button) releases allowing the spring to move the face plate into the clean indication position. The shortcoming to this approach is the inability to automatically determine when clean dishes have been removed and dirty dishes have been loaded. If user forgets to depress the button to reset device to "dirty" indication, device will indicate "clean" when dirty dishes are present.

U.S. Pat. No. 5,839,458 discloses an indicating device which consists of, among other things, a frame and a release arm that are physically mounted on one of the two dish racks inside the dishwasher. The frame and release arm mechanism appears to accommodate a single item to be washed. The presence or absent of this single item from the release arm provides an indication of a loaded or unloaded condition respectively for the entire dishwasher. It can easily be seen that if the user happens to load the dishwasher without placing at least one item in direct contact with the frame and release arm mechanism, the proper loaded and unloaded conditions will not be detected. In addition, the above device uses a number of metallic springs the will be subject to the high temperature of the wash water and caustic nature of the cleansing agents. The combination of these two substances could cause the corrosion and degradation of the functioning of these springs over an extended period of time.

Furthermore, U.S. Pat. No. 5,229,753 discloses an indicating device in which a significant amount of effort has been devoted to addressing the issues of automatically detecting the clean/unload and dirty/load states of the dishwasher. The indicating system in said device includes a state means responsive to the timer means responsible for controlling the automatic washing cycle of a dishwasher. This timer means typically consisting of an on-off switch, part of the dishwasher timing apparatus, also operates other electrical functions of the dishwasher. The indicating device includes a spring means responsive to the loading and unloading of articles in at least one rack of the dishwasher. Said device includes ultraviolet energy source, reflector and detector means which work in conjunction with spring means to sense the loading and unloading through the displacement of the same. Also included in the device is a rack withdrawal detector responsive to a dishwasher rack being placed in an unloading position and attached to at least one of the dishwasher racks. Finally, all of the above detection means are interconnected with the state means by a system of AND gate means. Once the appropriate combination of conditions exist, the state means registers either a "clean" or "dirty" article state and that state is reported by the voice generating reporting means of the device responsive to said states.

The electrically-controlled system described in U.S. Pat. No. 5,229,753 appears to require a direct connection to the mechanism controlling the automatic washing timer cycle of the dishwashing machine. Creating such a connection would not be something the average consumer should be advised to perform nor would it be recommended by dishwashing appliance manufacturer. Therefore, there would be limited application for the device in the direct-user aftermarket. The remainder of the system is obviously somewhat complicated and could significantly increase the cost of the dishwashing machine if provided already integrated by the manufacturer. Finally, having the majority of the device's detection components contained within the dishwashing compartment again subjects them to the high temperature of the wash water and caustic nature of the cleansing agents. As stated earlier, this could lead to the corrosion and degradation of the function of these components over an extended period of time.

U. S. Pat. No. 9,119,522 discloses a device which takes an electronically-controlled approach by using a wireless receiver to communicate with the existing electrical system of the dishwashing appliance via a transceiver. It appears that the transceiver interfaces with the electrical system of a dishwashing appliance and wirelessly conveys to the wireless receiver, to be externally displayed, message signals corresponding to conditions realized within the dishwashing appliance. Requiring the use of a dishwashing appliance internal, possibly proprietary, interfaces may pose a limitation on consumer aftermarket applications.

SUMMARY OF INVENTION

The present invention is designed to overcome the shortcomings of the prior art described above while providing a simple, inexpensive and easy to use device. The present invention comprises a heat sensing means attached to an extending member. In the preferred embodiment of present invention, said extending member is flexible and has a memory characteristic allowing it to retain the shape in which it has been flexed. Said extending member also comprises a hollow characteristic allowing wires from the heat sensing means to be passed through it from one end to the other. In the preferred embodiment of the present invention, a device housing member is provided from which said extending member extends. The present invention also comprises an inclination sensing means responsive to the deviation of the device from the vertical position.

Furthermore, the present invention comprises a state means and a group of timer means responsive to said sensing means. Finally, the present invention comprises indication and warning means which are indicative of at least two states ("clean" and "soiled") and visibly attached to or projecting through the outside surface of said device housing member. Said indication and warning means are responsive to said state means.

In the preferred embodiment of the present invention, the device housing member is releasably attached to the outside surface of the dishwasher door just below the venting slot. The device is attached by fastening means consisting of opposing portions of tape material; one with a surface of tiny hooks and the other with a surface of tiny latches that interlock when pressed together in the preferred embodiment. It is understood that numerous other fastening means could be used for its attachment. In the preferred embodiment, the present invention may be powered by one or more power cells (not shown or specified) which load into rear of device housing member. Said state means is automatically placed in the "soiled" state when device initially receives power. Said heat sensing means attached to extending member is inserted into venting slot of the dishwasher.

While the dishwasher, loaded with soiled items, is run through the automatic washing cycle, the temperature of the dishwasher compartment elevates to a predetermine point by the hot water present. Said heat sensing means inserted into the venting slot senses the elevated temperature for a given period of time predetermined by a first timing means and automatically changes said state means to the "clean" state. If the temperature of the automatic washing cycle is not quite hot enough, several dishwashers employ a "heated dry" step at the end of the automatic washing cycle which also will be sensed by the heat sensing means inserted into the venting slot, thereby changing said state means to the "clean" state. Once the state means has transitioned to the "clean" state, said indication and warning means will indicate "clean".

In the preferred embodiment of the present invention, upon opening the dishwasher door, said inclination sensing means will detect an "open door" condition and starts a second timing means. If the device is in the "clean" state, a "clean" visual and audible warning will be sounded by said indication and warning means for a predetermined length of time. The combined indication and audible warning will alert the user that clean dishes, glasses and/or utensils are present in dishwasher. If the door is closed immediately, the audible warning and timing sequence of said second timing means will be terminated. If the dishwasher door remains open, said second timing mean will begin measuring the passage of time. If the period of time exceeds a predetermined threshold, the device assumes that the "clean" contents of the dishwasher is being unloaded. A third timing means commences after said threshold. If the period of time that dishwasher door remains opens exceeds the predetermined time of said third timing means, said state means is automatically changed to the "dirty" state. Said indication and warning means will indicate "dirty."

One advantage of the present invention is that it automatically determines the "clean" and "dirty" states of the contents of a dishwasher without being directly or wirelessly connected to the dishwasher automatic wash cycle control timing apparatus or electrical/electronic interfaces.

Another advantage of the present invention is that it does not require any physical, electrical or optical attachment to one or both of the dish racks of the dishwasher to automatically determine the "clean" and "dirty" states of the contents. No water is required to be viewed and emptied from any vessel or container.

Yet another advantage of the present invention is that it does need any components of the device to physically reside in the dishwashing compartment, exposed to the high temperature of the wash water and caustic nature of the cleansing agents, in order to automatically determine the "clean" and "dirty" states of the contents of a dishwasher.

Still another advantage of the present invention is to provide both external and built-in configurations which allow placement on in-use dishwashers or in newly manufactured dishwashers, respectively, with no user wiring or circuit connection requirements.

Other and further advantages will be obvious upon examining the following detailed description. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

Figure 1:
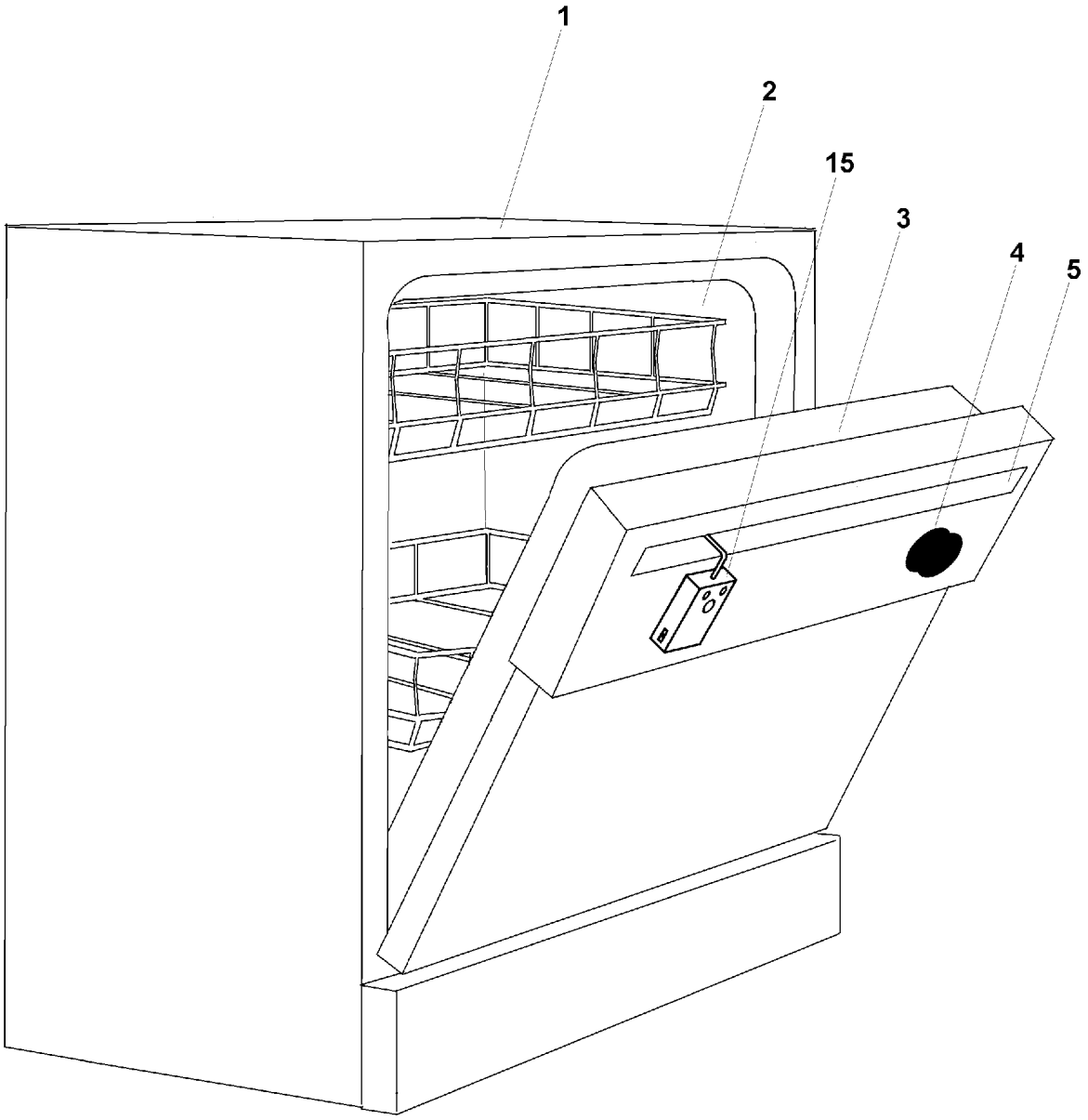
FIG. 1 is a perspective view of a conventional front-loading dishwashing machine with a vented drop-down door. The present invention is shown attached to the front of the opened slightly Inclined dishwashing machine door.

Referring to FIG. 1, the present invention 15 is shown mounted to a conventional front-loaded dishwashing machine 1. In particular, the preferred embodiment of said present invention 15 is mounted to the door 3 of said dishwashing machine 1 just below the venting slot 5. The preferred embodiment of the present invention is shown in the external configuration, however, it is yet another advantage of the present invention of having both an external and a built-in configuration (not shown) allowing the present invention 15 to be mounted directly inside the door 3 of said dishwashing machine 1.

Dishes and utensils are placed in dishwashing compartment 2 of said dishwashing machine 1, the door 3 is closed and the dishwashing machine control 4 is manipulated to operated said dishwashing machine 1.

Figure 2:
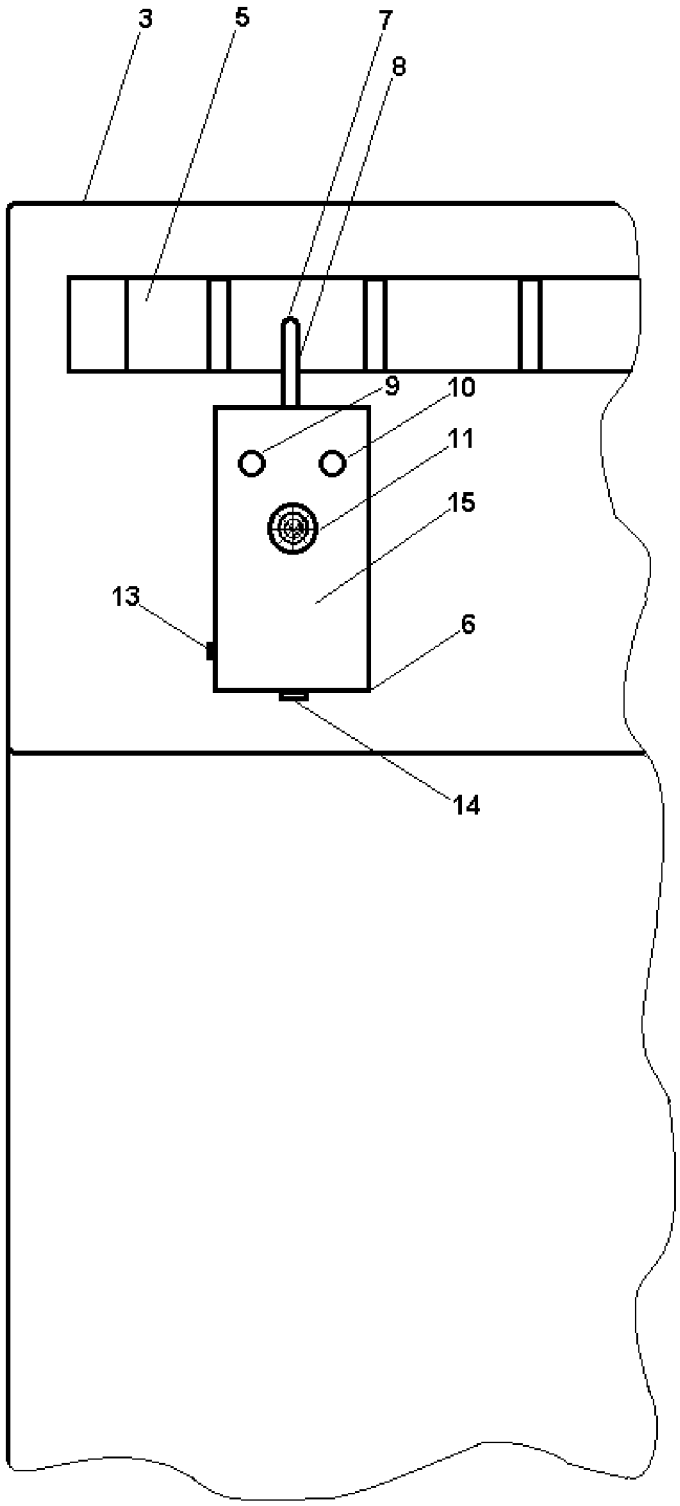
FIG. 2 is a front view of the present invention attached to the door of said dishwashing machine with door in the fully upright position.

Referring to FIG. 2, various aspects of the present invention 15, mounted to dishwashing machine door 3, are shown from the front view. The present invention comprises a heat sensing means 7 attached to an extending member 8. In the preferred embodiment of present invention, said extending member 8 is flexible and has a memory characteristic allowing it to retain the shape in which it has been flexed. Said extending member 8 also has a hollow characteristic allowing wires from the heat sensing means 7 to be passed through it from one end to the other. In the preferred embodiment of the present invention, a device housing member 6 is provided from which said extending member 8 extends. The present invention comprised a first visual display means 9, second visual display means 10 and audible transducing means 11 which are indicative of at least two states ("clean" and "soiled") and visibly attached to and/or projecting through the outside surface of said device housing member 6.

The preferred embodiment of the present invention comprises at least two switching means which are attached to and may appear to protrude from or be recessed to the surface of said device housing 6. The first such switching means is a variable duration timer settings switch means 13 which in the preferred embodiment of the present invention comprises at least three settings (indicating small, medium or large load) and the second such switching means is a cycle reset switch means 14 having a momentary contact setting.

Figure 3:
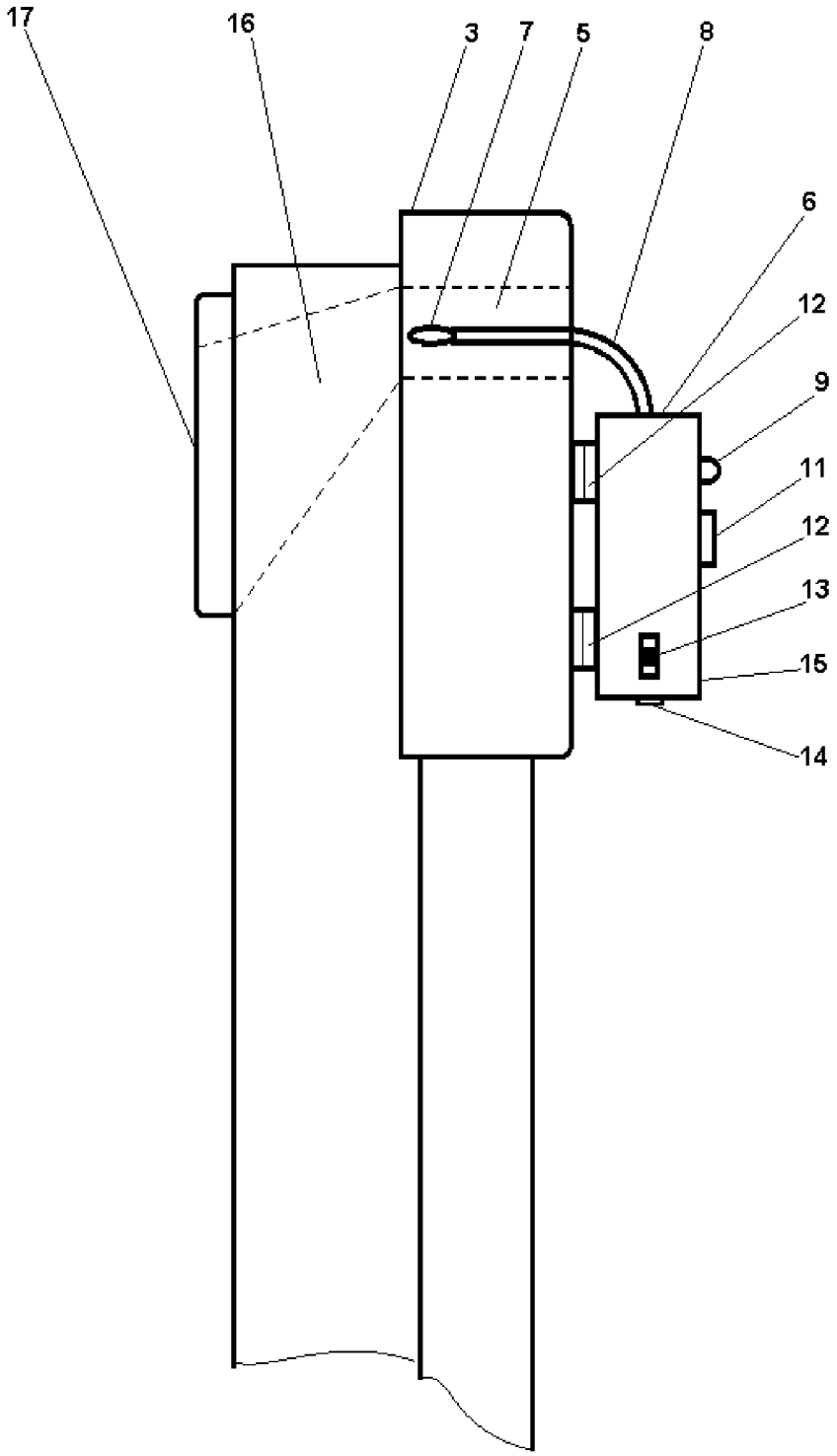
FIG. 3 is a left side view of the present invention attached to the door of said dishwashing machine with door in the fully upright position.

Referring to FIG. 3, clearly visible in left side view is said heat sensing means 7 attached to said extending member 8 which extends from said device housing member 6. Said heat sensing means 7 attached to said extending member 8 is inserted into vent slot 5 of dishwashing machine door 3. The dashed lines of FIG. 3 represent the internal nature of vent slot 5 and vent well 16 which extends downward inside dishwashing machine door 3 and attached to vent opening 17 on the opposite side of dishwashing machine door 3. Also shown are first visual display means 9, audible transducing means 11, variable duration timer settings switch means 13 and cycle reset switch means 14. All of which are described in the proceeding paragraphs.

In the preferred embodiment of the present invention, said device housing member 6 is attached to the outside surface of the dishwashing machine door 3 just below venting slot 5. The device is attached by fastening means 12 consisting of opposing portions of tape material; one with a surface of tiny hooks and the other with a surface of tiny latches which in the preferred embodiment of the present invention removably interlock when pressed together.

Figure 4:
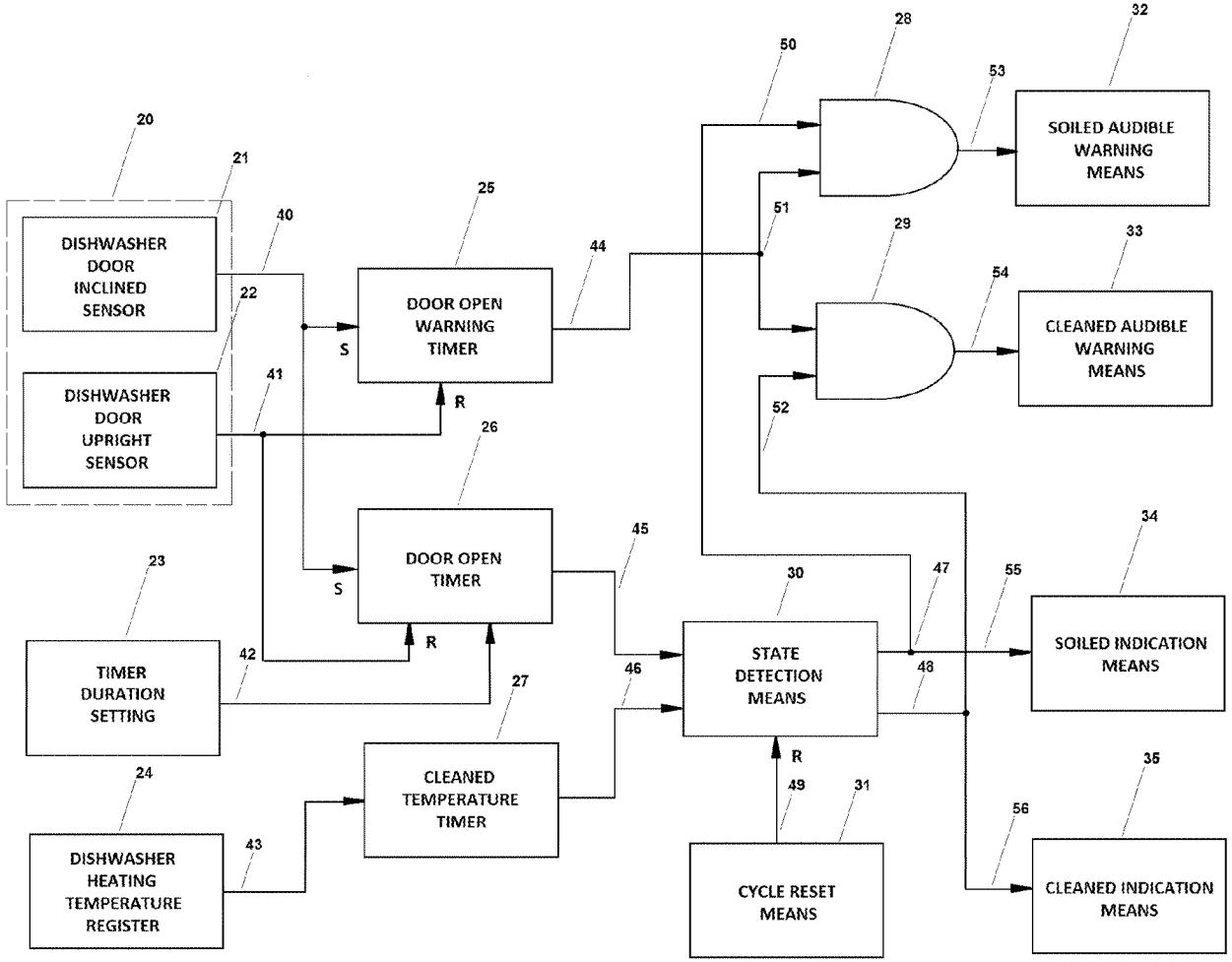
FIG. 4 is a schematic diagram representing the logical components of the present invention.

Referring to FIG. 4, the logical components of the present invention are represented. References 20 through 54, in the preferred embodiment of present invention are performed within said device housing means 6 (FIG. 2 and FIG. 3). The present invention logical components comprise an inclination sensing means 20 responsive to the deviation of the mounted device 15 (FIG. 1-FIG. 3.) from the vertical position. Said inclination sensing mean 20 comprises at least two sensing components. The first such component Dishwasher Door Inclined Sensor 21 senses when the dishwashing machine door is in an inclined position from vertical and a second such component Dishwasher Door Upright Sensor 22 senses when the dishwashing machine door is in the closed position. The present invention logical components comprise a Timer Duration Setting means 23 which stores a current timer duration set by the variable duration timer settings switch means 13 (FIG. 2 and FIG. 3). Each timer duration setting represents the expected amount of time it should take to completely unload the cleaned contents of the dishwashing machine. The present invention logical components comprise a Dishwasher Heating Temperature Register 24 which stores the current temperature detected by said heat sensing means 7 (FIG. 2 and FIG. 3). The above is accomplished through a connection between said heat sensing means 7 and said Dishwasher Heating Temperature Register 24 which extends through extending member 8 into device housing member 6 (FIG. 2 and FIG. 3).

The present invention logical components further comprise a Door Open Warning Timer 25 which determines the length of time that a door open state warning should be sounded. The present invention logical components comprise a Door Open Timer 26 which determines whether the dishwashing machine door has remained open beyond the time duration stored in said Timer Duration Setting means 23. The present invention logical components also comprise a Cleaned Temperature Timer 27 which determines whether the dishwashing machine has reached and maintained the temperature stored in Dishwasher Heating Temperature Register 24 for a specific amount of time which is at least fifteen (15) minutes in the preferred embodiment.

The present invention logical components further comprise Dual logical AND Gates 28 and 29. The present invention logical components comprise State Detection Means 30 which determines the current state (soiled/cleaned) of the contents of the dishwashing machine at any given time. The present invention logical components also comprise Cycle Reset Means 31 which is activated by cycle reset switch means 14 (FIG. 2 and FIG. 3) momentary contact setting. Said Cycle Reset Means 31 returns State Detection Means 30 to the initial state which represents that dishwashing machine contents is "soiled."

The present invention logical components further comprise at least two (2) audible warning means each producing sounds at separate and distinct tones and/or frequencies. In the preferred embodiment of the present invention, the first such warning means is the Soiled Audible Warning Means 32 and the second such warning means is the Cleaned Audible Warning Means 33. Said audible warning means 32 and 33 produce an audible warning through audible transducing means 11 (FIG. 2 and FIG. 3). The present invention logical components also comprise at least two (2) indications means each producing a visual display at separate and distinct colors and/or patterns. In the preferred embodiment of the present invention, the first such indication means is the Soiled Indication Means 34 and the second such indication means is the Cleaned Indication Means 35. Said indication means 34 and 35 are visible through display means 9 and 10 respectively (FIG. 2 and FIG. 3).

Referring to FIG. 1, the present invention 15 is mounted to a conventional front-loaded dishwashing machine 1. The door 3 of said dishwashing machine is lowered to the fully opened position and soiled dishes and utensils are placed in dishwashing compartment 2. The variable duration timer settings switch means 13 (FIG. 2 and FIG. 3) on present invention 15 is set to one of at least three settings (indicating small, medium or large load). The door 3 is closed and the dishwashing machine control 4 is manipulated to start operation of said dishwashing machine 1. The dishwashing cycle begins. After a short while (approximately three minutes), the temperature in dishwashing compartment 2 begins to increase.

Referring to FIG. 3, the increasing temperature in the dishwashing compartment 2 (FIG. 1) causes hot air to rise through vent opening 17 and vent well 16, and escape pass the heat sensing means 7 attached to said extending member 8 which is inserted into vent slot 5 of dishwashing machine door 3. The heat passing through the vent slot 5 is detected by said heat sensing means 7. The prevailing temperature is passed to Dishwasher Heating Temperature Register 24 (FIG. 4) by a connection which extends from heat sensing means 7 through extending member 8 into device housing member 6 (FIG. 2 and FIG. 3). Dishwasher Heating Temperature Register 24 stores said temperature.

Referring to FIG. 4, once the registered temperature exceeds a predetermined value (e.g., 120° F.), an activating signal is sent over line 43 to Cleaned Temperature Timer 27 which measures the length of time that the registered cleaned temperature remains elevated. If the registered temperature is maintained at or above said predetermined temperature value for a specified length of time (e.g., 15 mins.), an activating signal is sent over line 46 to the State Detection Means 30 which causes its state to change from "soiled" to "cleaned." The "cleaned" state of State Detection Means 30 produces an activating signal on line 48 which in turn is delivered to line 52 the lower portion of logical AND Gate 29 and line 56 the input to Cleaned Indication Means 35. Said activating signal on line 56 activates Cleaned Indication Means 35 producing an illuminance through said second visual display means 10 (FIG. 2) signifying that any content present in dishwashing machine is "cleaned."

Further referring to FIG. 4, at any point during the washing cycle or thereafter, if the dishwashing machine door 3 (FIG. 1) is opened, the Dishwasher Door Inclined Sensor 21 portion of the inclination sensing means 20 senses the door open condition and produces an activating signal on line 40 which in turn delivers "set" input signals S to both Door Open Warning Timer 25 and Door Open Timer 26.

If State Detection Means 30 has reached "cleaned" state of wash cycle, set input signal to Door Open Warning Timer 25 produces a timed duration (e.g., 10 second) activating signal on line 44 which in turn is delivered over line 51 to both the upper portion of logical AND Gate 29 and the lower portion of logical AND Gate 28. The combined activating signals on lines 51 and 52 to logical AND Gate 29 produces an activating signal sent over line 54 to Cleaned Audible Warning Means 33 which produces a "cleaned" audible warning through audible transducing means 11 (FIG. 2 and FIG. 3). The "cleaned" audible warning will be produced up to at most said timed duration (e.g., 10 second).

Otherwise, State Detection Means 30 is still in "soiled" state of wash cycle, set input signal to Door Open Warning Timer 25 produces a timed duration (e.g., 10 second) activating signal on line 44 which in turn is delivered over line 51 to both the upper portion of logical AND Gate 29 and the lower portion of logical AND Gate 28. The combined activating signals on lines 51 and 50 to logical AND Gate 28 producing an activating signal sent over line 53 to Soiled Audible Warning Means 32 which produces a "soiled" audible warning through audible transducing means 11 (FIG. 2 and FIG. 3). The "soiled" audible warning will be produced up to at most said timed duration (e.g., 10 second).

Set input signal to Door Open Timer 26 which measures the amount of time that the dishwashing machine door 3 (FIG. 1) has remained open with respect to the time duration stored in Timer Duration Setting means 23. The stored time represents the amount of time required to completely remove the cleaned contents of the dishwashing machine. Once the elapsed time measured by Door Open Timer 26 reaches the time stored in Timer Duration Setting means 23, an activating signal is sent over line 45 to the State Detection Means 30 which causes its state to change from "cleaned" to "soiled." The "soiled" state of State Detection Means 30 produces an activating signal on line 47 which in turn is delivered to line 50 the upper portion of logical AND Gate 28 and line 55 the input to Soiled Indication Means 34. Said activating signal on line 55 activates Soiled Indication Means 34 producing an illuminance through said first visual display means 9 (FIG. 2) signifying that any content present in dishwashing machine is "soiled."

Again referring to FIG. 4, at any point during the washing cycle or thereafter, if the opened dishwashing machine door 3 (FIG. 1) is closed, the Dishwasher Door Upright Sensor 22 portion of the inclination sensing means 20 senses the door closed condition and produces an activating signal on line 41 which in turn delivers "reset" input signals R to both Door Open Warning Timer 25 and Door Open Timer 26.

If State Detection Means 30 has reached "cleaned" state of wash cycle, reset input signal to Door Open Warning Timer 25 immediately removes any activating signal on line 44 which in turn removes any existing activating signals delivered over line 51 to both the upper portion of logical AND Gate 29 and the lower portion of logical AND Gate 28. Removal of any activating signal on line 51 to logical AND Gate 29 will remove any activating signal sent over line 54 to Cleaned Audible Warning Means 33 thereby silencing any existing "cleaned" audible warning produced through audible transducing means 11 (FIG. 2 and FIG. 3). There is no change to the current state of State Detection Means 30.

Otherwise, State Detection Means 30 is still in "soiled" state of wash cycle, reset input signal to Door Open Warning Timer 25 immediately removes any activating signal on line 44 which in turn removes any existing activating signals delivered over line 51 to both the upper portion of logical AND Gate 29 and the lower portion of logical AND Gate 28. Removal of any activating signal on line 51 to logical AND Gate 28 will remove any activating signal sent over line 53 to Soiled Audible Warning Means 32 thereby silencing any existing "soiled" audible warning produced through audible transducing means 11 (FIG. 2 and FIG. 3). There is no change to the current state of State Detection Means 30.

Reset input signal to Door Open Timer 26 terminates any measurement of the amount of time that the dishwashing machine door 3 (FIG. 1) has remained open regardless of the time duration stored in Timer Duration Setting means 23. No activating signal will be produced on line 45. There is no change to the current state of State Detection Means 30 state.

I claim:

1. An indicative device for indicating a current cleaned or soiled state of the contents of a dishwashing apparatus which possesses at least one dishwashing compartment, at least one opening of said dishwashing compartment, at least one door which covers said opening and at least one vent slot and well which connects said dishwashing compartment to the outside of said dishwashing apparatus, said indicative device comprising an inclination detection means for detecting the orientation of said door with respect to said opening of said dishwashing compartment, said inclination detection means possessing at least two sensing components: a door inclined sensor; and a door upright sensor.

2. The indicative device described in claim 1 comprising a housing which attaches to said door of the dishwashing apparatus, said indicative device further comprising a heat sensing means capable of detecting an internal temperature change of said dishwashing compartment of the dishwashing apparatus without physically being present within said dishwashing compartment and said heat sensing means comprising at least one pair of leads capable of conveying a temperature signal from said heat sensing means, a flexible extending member comprising a hollow characteristic allowing said leads of said heat sensing means to be passed through said flexible extending member from one end to the opposite end; a memory characteristic enabling said flexible extending member to retain the shape in which said flexible extending member has been flexed and an attachment of said heat sensing means to one end of said flexible extending member.

3. The indicative device described in claim 2 further comprising a group of logical components present within said housing, a power source present within said housing and an opening of said housing which accommodates an attachment of the free end of said flexible extending member, the end opposite said heat sensing means, to said opening.

4. A method of indicating the current cleaned or soiled state of the contents of a dishwashing apparatus which possesses at least one dishwashing compartment, at least one opening of said dishwashing compartment, at least one door which covers said opening and at least one vent slot and well which connects said dishwashing compartment to the outside of said dishwashing apparatus, said method comprising the steps of detecting any position of said door between a fully open position and an upright position with respect to said opening of said dishwashing compartment and sensing an internal temperature change of said dishwashing compartment of the dishwashing apparatus to determine whether the contents of said dishwashing compartment is soiled or cleaned without the sensing means being present within said dishwashing compartment.

5. The method described in claim 4 further comprising the step of producing an output triggering signal when said door is placed in said open position.

6. The method described in claim 5 further comprising the step of producing an output triggering signal when said door is placed in said upright position.

7. The method described in claim 6 further comprising the steps of using said output triggering signal to initiate a door open warning timing cycle which controls the length of time a door open warning will be produced and using said output triggering signal to initiate a door open timing cycle which is used to determine whether said door has been open long enough to completely remove the cleaned contents from said dishwashing compartment.

8. The method described in claim 7 comprising the steps of using said output triggering signal to stop and reset the timing cycles for said door open warning and said door open conditions.

9. The method described in claim 8 further comprising the steps of defining a plurality of timing cycle durations for said door open timing cycle and selecting a single timing cycle duration as an operating value for said door open timing cycle.

10. The method described in claim 9 further comprising the steps of defining and storing at least one representation of a predetermined cleaned temperature value for said dishwashing compartment, sensing and storing a representation of the current detected internal temperature value of said dishwashing compartment, performing a comparison of the representation of said stored current detected internal temperature value to the representation of said stored predetermined clean temperature value and producing a cleaned temperature output triggering signal when said representation of the stored current detected internal temperature value reaches or exceeds said representation of the stored predetermined cleaned temperature value.

11. The method described in claim 10 further comprising the steps of using said cleaned temperature output triggering signal from the comparison of the representation of said sensed and stored temperature value to the representation of said predetermined stored cleaned temperature value to initiate a cleaned temperature timing cycle which in turn produces a state detection triggering signal if the representation of said sensed and stored cleaned temperature value continues to produce said cleaned temperature triggering signal until the end of said clean temperature timing cycle.

12. The method described in claim 11 comprising the steps of using a state detection means comprising of at least three inputs: each accepting a separate triggering signal;

a first input accepting a triggering signal to change said state detection means to a state of soiled, a second input accepting a triggering signal to change said state detection means to a state of cleaned and a third input accepting a reset triggering signal to reset said state detection means to an initial state of soiled and at least two outputs: each producing a separate triggering signal; a first output producing a triggering signal when said state detection means changes to a soiled state and a second output producing a triggering signal when said state detection means changes to a cleaned state.

13. The method described in claim 12 further comprising the steps of using said state detection means to determine the soiled or the cleaned state of the contents of said dishwashing compartment of the dishwashing apparatus based on said triggering signal applied to at least said first or said second input; and provide an indicative response in the form of a triggering signal produced on at least one of said first or said second outputs.

14. The method described in claim 13 further comprising the use of a cycle reset switch means to reset the current state to soiled.

15. The method described in claim 14 comprising the use of a dual AND logic means having at least the adjacent inputs of both of the AND logic components of said dual AND logic means commonly connected to accept said output triggering signal of said door open warning timing cycle in order to provide an indicative response in the form of an output triggering signal produced on one of said dual AND logic means component outputs based on said door open warning triggering signal applied to said dual AND logic means commonly connected inputs and a separate triggering signal applied to one of the opposing dual AND logic means component inputs.

16. The method described in claim 15 further comprising indicating the soiled state by producing a first visual display, said state detection means first output triggering signal activating said first visual display.

17. The method described in claim 16 further comprising indicating the cleaned state by producing a second visual display, said state detection means second output triggering signal is activating said second visual display.

18. The method described in claim 17 further comprising indicating the soiled state by producing a first audible warning, said dual AND logic means having said adjacent inputs of both said AND logic components commonly connected to accept said output triggering signal of said door open warning cycle, said state detection means first output triggering signal applied to said opposing dual AND logic means component upper input and the associated output triggering signal of said dual AND logic means component applied to said soiled audible warning means.

19. The method described in claim 18 further comprising indicating the cleaned state by producing a second audible warning, said dual AND logic means having said adjacent inputs of both said AND logic components commonly connected to accept said output triggering signal of said door open warning cycle, said state detection means second output triggering signal applied to said opposing dual AND logic means component lower input and the associated output triggering signal of said dual AND logic means component applied to said second audible warning.

* * * * *